US007428402B2

(12) United States Patent
Hays et al.

(10) Patent No.: US 7,428,402 B2
(45) Date of Patent: Sep. 23, 2008

(54) CARBON NANOTUBE COMPOSITES FOR BLADE CLEANING IN ELECTROPHOTOGRAPHIC MARKING SYSTEMS

(75) Inventors: Dan A. Hays, Fairport, NY (US); Bruce E. Thayer, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 163 days.

(21) Appl. No.: 11/493,071

(22) Filed: Jul. 26, 2006

(65) Prior Publication Data

US 2008/0025775 A1 Jan. 31, 2008

(51) Int. Cl.
*G03G 21/00* (2006.01)

(52) U.S. Cl. ..... 399/350; 15/256.5

(58) Field of Classification Search ..... 399/350, 399/349, 343, 327, 326, 101, 100, 99; 15/256.5, 15/256.51, 256.52; 430/125.31
See application file for complete search history.

(56) References Cited

U.S. PATENT DOCUMENTS 4,937,633 A * 6/1990 Ewing ..... 15/256.5 X
5,117,264 A * 5/1992 Frankel et al. ..... 399/350
5,732,320 A * 3/1998 Domagall et al. ..... 399/350
5,940,661 A * 8/1999 Yagi et al. ..... 399/350 X
7,172,796 B2 * 2/2007 Kinoshita et al. ..... 428/36.3
2005/0214033 A1 * 9/2005 MacMillan et al. ..... 399/284
2006/0112512 A1 * 6/2006 McNeil ..... 15/250.48
2007/0286653 A1 * 12/2007 Watanabe et al. ..... 399/350
2008/0008504 A1 * 1/2008 Campbell et al. ..... 399/281

FOREIGN PATENT DOCUMENTS

JP 61-279881 A * 12/1986
JP 05-046056 A * 2/1993

* cited by examiner

*Primary Examiner*—Sophia S Chen
(74) *Attorney, Agent, or Firm*—James J. Ralabate

(57) ABSTRACT

A cleaning blade is used to clean a photoreceptor surface in an electrophotographic marking system. The elastomeric blade contains an amount of carbon nanotubes that improves the mechanical, electrical and thermal properties for cleaning the photoreceptor surface. The nanotubes can be disposed throughout the elastomer in the blade or can be dispersed only at a tip of the blade or only in the bottom section of the blade.

5 Claims, 6 Drawing Sheets

CARBON NANOTUBE COMPOSITES FOR BLADE CLEANING IN ELECTROPHOTOGRAPHIC MARKING SYSTEMS

FIELD

This invention relates to an electrophotographic marking system process and more specifically to a photoconductor cleaning blade system useful in said process.

CROSS REFERENCE

In Ser. No. 11/167,158, filed on Jun. 28, 2005 presently pending in the U.S. Patent and Trademark Office, a fuser or fixing members for use in a photosensitive marking system are disclosed. This fuser member includes a substrate where the coating layer comprises carbon nanotubes dispersed in a polymeric binder material. Also disclosed in Ser. No. 11/167,158 is an electrostatic printing apparatus using this fusing and fixing member.

This Ser. No. 11/167,158 and the present application, ID 20052195, are both owned by the present assignee, Xerox Corporation.

BACKGROUND

In marking systems such as Xerography or other electrostatographic processes, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner upon the photoreceptor surface. The charged toner being electrostatically attached to the latent electrostatic image areas creates a visible replica of the original. The developed image is then usually transferred from the photoreceptor surface to a final support material, such as paper, and the toner image is fixed thereto to form a permanent record corresponding to the original.

In some Xerographic copiers or printers, a photoreceptor surface is generally arranged to move in an endless path through the various processing stations of the xerographic process. Since the photoreceptor surface is reusable, the toner image is then transferred to a final support material, such as paper, and the surface of the photoreceptor is prepared to be used once again for the reproduction of a copy of an original. In this endless path, several Xerographic related stations are traversed by the photoconductive belt.

Generally, in one embodiment, after the transfer station, a photoconductor cleaning station is next and it comprises a first cleaning brush, a second cleaning brush and after the brushes are positioned, a spots or cleaning blade which is used to remove residual debris from the belt such as toner additive and other filming. This film is generally caused by the toner being impacted onto the belt by the cleaning brushes. When the lubrication of this blade is below a necessary level, it will abrade the belt. Toner is the primary lubricant for the blade; however, a problem is with good cleaning efficiency by the cleaning brushes, the amount of toner reaching the blade can often be well below this necessary level. Without proper lubrication, this spots blade will seriously abrade the belt.

Since most toners used today are negatively charged, the embodiments throughout this disclosure and claims will be described relating to the use of a negative toner; however, when a positive toner is used, the proper opposite adjustments can easily be made.

The first brush above mentioned in prior art systems is responsible for nearly all of the filming on the photoconductive (PC) belt. This brush is positively charged to attract a negative charged toner and remove most of it from the PC belt. Adjacent to the first brush is a vacuum which vacuums the toner from the brush for later disposal. Any toner that may have acquired a positive charge will pass by the first positively charged brush and will be picked up by the second brush which is negatively charged. The vacuum is also adjacent to the second brush and should vacuum off the brush any residual positively charged toner. Then, as above noted, the spots or cleaning blade scrapes off the belt any remaining toner debris or film layer. Again, after the action of the two prior cleaning brushes there is generally not sufficient toner lubrication for an effective action by this spots blade. The cleaning blade will remove the film layer comprised of toner additives that is caused by the impact of the first brush against the toner and PC belt. The serious problem that has been encountered in this type of prior art arrangement is, as noted, that the cleaning blade does not get enough toner provided lubrication and can easily scratch and damage the belt, causing a relatively high replacement rate for both the belt and the cleaning blade. In addition, copy quality begins to deteriorate as the cleaning blade is abraded and damaged or as the film is less effectively removed from the PC belt by this blade.

Many of the low volume electrophotographic printers and some high speed marking apparatus use elastic doctor blades to remove residual toner from drum or belt photoreceptors. Improvements in the reliability of such blades are desired to minimize/reduce wear induced defects and to extend the overall life of the cleaning blade. Unloaded polyurethane and other elastomeric materials are typically useful in cleaning blade materials. Improved materials are required to extend the useful life of such blades.

SUMMARY

The present embodiments involve the incorporation of carbon nanotubes in electrophotographic cleaning blades, said blades consisting of polyurethane or other suitable elastomeric matrix materials. Carbon nanotubes can be formed by a variety of known methods including carbon arc discharge, pulsed laser vaporization, chemical vapor deposition and high pressure CO. Other methods are discussed in the articles cited in paragraph [014] below. Examples of suitable elastomer materials include, but are not limited to, polyurethanes, organic rubbers such as ethylene/propylene diene, fortified organic rubbers, various copolymers, block copolymers, copolymer and elastomer blends, and the like. It is proposed that a small percentage of carbon nanotubes or even loadings up to 60% by weight can improve the robustness of the material without significant compromising the elastomeric properties. Thus, improvements in the latitude to defects caused by nip tucking that can induce tears in the blade edge is envisioned, as well as overall life extension for ultimate blade failure. Furthermore, addition of carbon nanotubes to the blades can significantly increase their electrical conductivity as well as the thermal conductivity. This enhanced electrical conductivity can dissipate charge accumulation at the blade due to rubbing against the photoreceptor and air breakdown from the accumulation of charged toner at the blade edge. The enhanced thermal conductivity can aid heat dissipation due to friction at the blade-photoreceptor interface. Carbon nanotubes (CNT) represent a new molecular form of carbon in which a single layer of atoms is rolled into a seamless tube that is on the order of 1 to 10 nanometers in diameter and up to hundreds of micrometers in length. (1) Multi-walled nanotubes (MWNT) were first discovered by Iijima of NEC Labs in 1991. Two years later, he discovered single-walled nanotubes (SWNT). Since then, nanotubes have captured the attention of researchers worldwide. The nanotubes can be either conducting or semi-conducting, depending on the chirality (twist) of the nanotubes. They have yield stresses much higher than that of steel, and can be kinked without permanent damage. The thermal conductivity of CNT is much higher than that of copper, and comparable to that of diamond. The nanotubes can be fabricated by a number of methods, including carbon arc discharge, pulsed laser vaporization, chemical vapor deposition (CVD) and high pressure CO. Variants of nanotubes that contain only carbon include nanotubes with equal amounts of boron and nitrogen.

Recent experiments report a significant increase in the thermal conductivity of polymers when filled with relatively low volume fractions of carbon nanotubes (2). For example, for only a 1% volume fraction of SWNT in epoxy, the composite thermal conductivity was approximately 0.5 $Wm^{-1}K^{-1}$ which was more than double the conductivity of the pure epoxy. This increase is attributed to the high thermal conductivity of nanotubes, which is believed to be 3000 $Wm^{-1}K^{-1}$ for MWNT (3) and even higher for SWNT (4); from 0.5-60% by weight loading of nanotubes may be used in the present cleaning blade. The composite thermal conductivity for a 1% loading is about 30 times less than what one expects from a model that assumes no thermal resistance at the interfaces between nanotubes. The disparity between the measurements and expectations might be due to a number of factors, including the dispersablity of the nanotubes in the matrix, a high interface thermal resistance or an altering of the nanotube conductivity by interactions with the matrix.

Carbon nanotubes (or nanofibers) dispersed in cleaning blades or spots blades may be used in electrophotographic systems using cleaning brushes or the cleaning or spots blades can be used by themselves without cleaning brushes. Reference to "blades" as used in this disclosure and claims will include both cleaning blades and spots blades. Spots blades are used to remove films on the photoconductive surface that the cleaning brushes don't remove. The carbon nanotubes may be randomly and/or oriented in the elastomer of the blade. These nanotubes may be dispersed throughout the entire blade or may be dispersed primarily at the bottom portion or bottom edge of the blade. This is because the bottom portion which contacts the photoconductive surface and experiences wear is the first to be damaged and causes replacement of the entire blade. Therefore, for example, in a blade 2 mm thick, the bottom 0.5-1.0 mm portion might have the greatest concentration of carbon nanotubes. For some photoreceptors, the surfaces of the photoconductor is being overcoated with harder materials to provide longer photoconductor lives. Cleaning blade edges operating on these overcoated photoconductors are worn at higher rates and result in earlier blade replacements. The blades of this invention make the blades used on overcoated photoconductors, as well as non-overcoated photoconductors, much more durable.

Measurements have been obtained at the Johnson Space Center on the strength and stiffness of a silicone elastomer filled with SWNT (6). The composite is stronger and stiffer than the unfilled elastomer. The manual mixing of 1% SWNT in the silicone increased the tensile strength by 44% and the elasticity modulus by 75%. The tensile strength and elasticity increased with higher SWNT loadings of 5% and 10%. By way of this example, it is clear that the inclusion of nanotubes into polyurethane cleaning blades can alter the mechanical properties for longer life performance.

Since the aspect ratio (length to diameter ratio) of carbon nanotubes is so high, the percolation limit (approximately the inverse of the aspect ratio) for electrical conductivity is much lower than typical conductive fillers such as carbon black. From Ref. 2 the percolation limit for the addition of SWNT in epoxy is between only 0.1 to 0.2 wt %. For higher loadings, the conductivity increases by a factor of $10^4$. Hyperion Catalysis, Inc. produces MWNT composite materials for a variety of applications that require conductive polymeric materials. It should be understood that the proposal to utilize carbon nanotube fillers in polyurethane and similar elastomeric materials for cleaning blades can provide significant performance advantages.

The following articles (whose contents are incorporated herewith) discuss various aspects of carbon nanotubes: (1) Oeulette J *The Industrial Physicist*, American Institute of Physics, December 2002/January 2003 18-21; (2) Biercuk, M. J. et al. Carbon nanotube composites for thermal management *Appl. Phys. Lett.* 80, 2767-2769 (2002); (3) Berber. S. et al. Unusually high thermal conductivity of carbon nanotubes, *Phys. Rev. Lett.* 84, 46134616; (4) Kim. P. et al. Thermal transport measurements of individual multiwalled nanotubes, *Phys. Rev. Lett.* 87, 215502-1, 215502-4 (2001); (5) Huxtable, S. T. et al. Interfacial heat flow in carbon nanotube composites (http://users.mrl.uiuc.edu/cahill/nt-revised.pdf) and (6) Files B S and Forest C R, Elastomer Filled with Single-Wall Carbon Nanotubes (http://www.nasatech.com/Briefs/Mar04//MSC23301.html).

Therefore, as earlier stated, the present embodiments involve the incorporation of carbon nanotubes in elastomeric cleaning blades when said blades are used in the cleaning stations of electrophotographic marking systems. It is provided that a small percentage of carbon nanotubes can improve the robustness of the material without significantly compromising the elastomeric properties. Increases in mechanical strength properties reduce blade edge tears and substantially extend blade life due to edge wear. Low percentage additions of carbon nanotubes can also significantly increase electrical and thermal conductiveness. Enhanced electrical conductivity can dissipate charge accumulation at the blade edge due to rubbing against the photoreceptor and air breakdown from the accumulation of charged toner at the blade edge. Enhanced thermal conductivity can aid heat dissipation due to friction at the blade-photoreceptor interface. Research with nanotubes has shown that mechanical strength and thermal and electrical conductivities have been achieved at concentrations of 1% or less by weight. Past experience with the addition of larger amounts of additives to blade material has often resulted in blades that were too stiff to be usable, but the very low concentrations of carbon nanotubes required to impact properties avoid this past problem. Included in this invention are "carbon nanotubes" which include nanotubes or its variants such as carbon nanofibers. As the carbon nanotube material, any of the currently known or after-developed carbon nanotube materials and variants can be used. Thus, for example, the carbon nanotubes can be on the order of from about 1 to about 10 nanometers in diameter and up to hundreds of micrometers or more in length. The carbon nanotubes can be in multi-walled forms, or a mixture thereof. The carbon nanotubes can be either conducting or semi-conducting. Variants of carbon nanotubes include, for example, nanofibers and are encompassed by the term "nanotubes" unless otherwise stated. In addition, the carbon nanotubes of the present disclosure can include only carbon atoms or they can include other atoms such as boron and/or nitrogen such as equal amounts of boron and nitrogen. Examples of nanotube material variants thus include boron nitride, bismuth and metal chalcogenides. Combinations of these materials can also be used and are encompassed by the term "carbon nanotubes" herein.

In embodiments, the carbon nanotubes can be incorporated as a filler into the elastomer layer of a cleaning blade in any desirable and effective amount. For example, a suitable loading amount can range from about 0.5 or from about 1 weight percent, to as high as about 50 or 60 weight percent or more. However, loading amounts of from about 1 or from about 5 to about 20 or about 30 weight percent may be desired in some embodiments. The composite of the blade is stronger and stiffer than the unfilled elastomer. The manual mixing of 1% by weight of single-walled nanotubes in the elastomer increased the tensile strength by 44% and the elasticity modulus by 75%. The tensile strength and elasticity modulus further increase with increased loading amounts of 5% and 10%. An increase in electrical conductivity helps mitigate the possibility of image distortion or disturbance by charge accumulation on the surface of the photoconductor and cleaning blade.

The blades can be used in the cleaning stations of marking systems with cleaning brushes (FIGS. 1 and 2) or in marking systems alone without cleaning brushes as shown in FIGS. 3 and 4 of the drawings.

Figure 6:
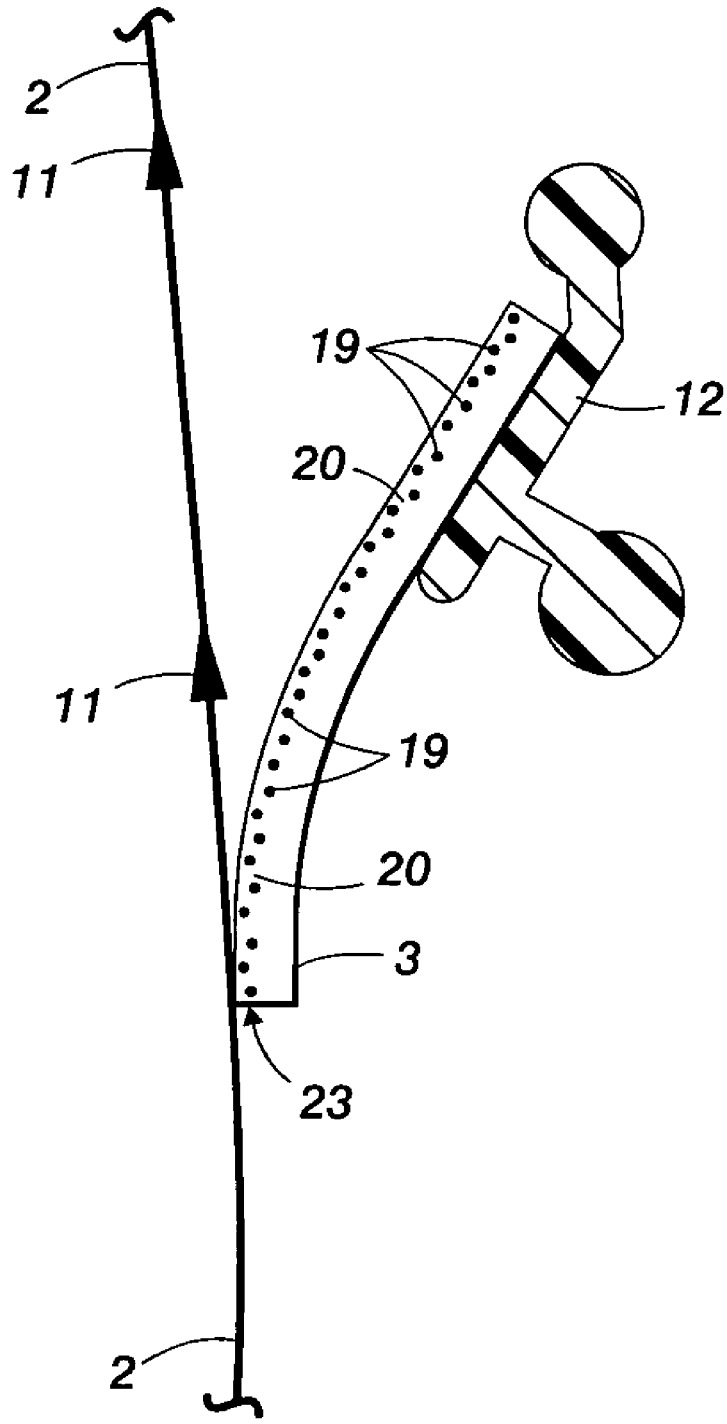

On FIG. 6, the carbon nanotubes are dispersed primarily along the bottom edge of the blade.

DETAILED DISCUSSION OF DRAWINGS AND PREFERRED EMBODIMENTS

Figure 1:
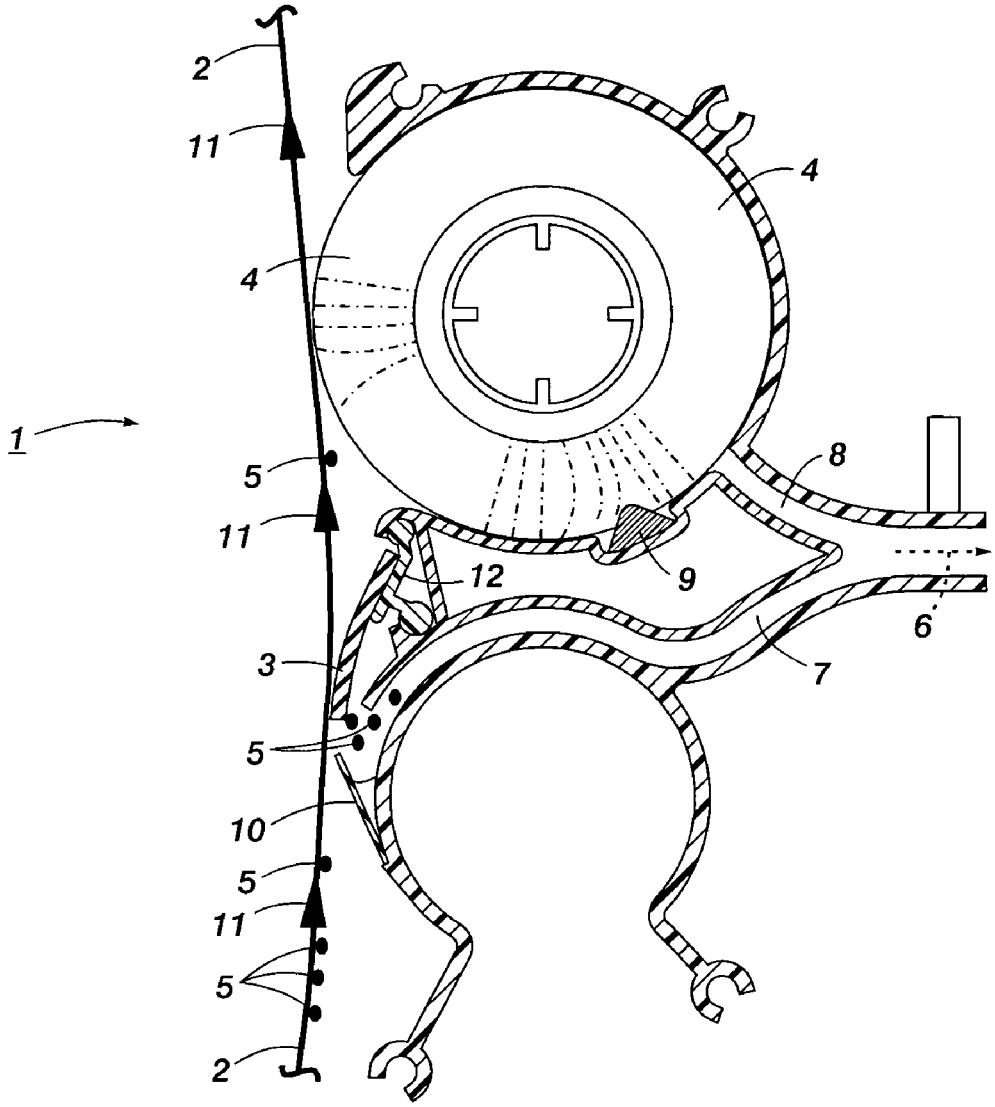
In FIG. 1, an embodiment of a marking system using a cleaning brush and the cleaning blade of this invention is illustrated.

The use of embodiments of the blades of this invention are described in the following figures:

In FIG. 1, cleaning system 1 of an embodiment, a photoconductive belt 2 is shown as it is adapted to move sequentially first to the cleaning blade 3 and then to an electrostatic brush 4. The elastomeric cleaning blade 3 incorporates carbon nanotubes, the nanotubes comprising no more than about 60% by weight of the entire blade. The arrows 11 show the direction and path of the PC belt 2. The blade 3 is therefore upstream from the brush 4 and is the first cleaning component that contacts the belt. In this position, blade 3 gets the proper toner induced lubrication since toner has not been previously removed by a brush 4 or any other component. The electrostatic brush 4 has a charge on it that is opposite to the charge on the toner 5 used in the system. This will permit brush 4 to attract the opposite charged toner 5 and remove any residual toner 5 not removed from the PC belt 2 by the cleaning blade 3. As above stated, since the cleaning blade 3 is the first cleaning component contacted by the belt 2, there is sufficient toner 5 on the belt at that point to provide ample lubrication for the blade 3 and minimize abrasion of the belt 2. The electrostatic brush 4 in system 1 follows the blade 3 to remove any residual toner 5. In an embodiment, a vacuum unit 6 is positioned between the blade 3 and brush 4 to vacuum off any loose toner removed by either blade 3 and brush 4. After the toner is vacuumed out it can be disposed of by any suitable method. Vacuum air channels 7 and 8 are in air flow contact with the blade 3 and brush 4, respectively. A flicker bar 9 is in operative contact with brush 4 and is adapted to de-tone brush 4 together with vacuum unit 6. As toner 5 is flicked off brush 4 by flicker bar 9, it is picked up by the suction of vacuum channel 8 and transported out of system 1. Flicker bar 9 is positioned such that the fibers in the rotation brush 4 will contact the flicker bar 9 prior to reaching the vacuum channel 8. In FIG. 1, the flicker bar 9 is shown in a position consistent with a counterclockwise brush 4 rotation. Clockwise brush 4 rotation can also be used with the flicker bar 9 in a suitable position. An entry shield 10 is located below the cleaning blade 3 and directs loosened toner into vacuum channel 7 for removal from system 1. Toner 5, therefore, is sequentially removed from photoconductor belt 2 by first contact with blade 3 which scrapes toner 5 off belt 2 and then by cleaner brush 4 which removes any residual toner by brush action together with electrostatic action (since it is biased oppositely to toner). The arrows 11 indicate the travel direction of belt 2, blade 3 is "upstream" and brush 4 is "downstream" as used in this disclosure. By this continuous contact with the photoconductive belt 2, the blade 3 in the prior art becomes worn and torn at the blade edges which significantly reduces the effective life of the blade. With the carbon nanotube containing blades 3 of this invention up to 0.5% to about 60% by weight, the blade 3 life is significantly increased. The nanotubes addition significantly increases the electrical conductivity and thermal conductivity of the blade 3. This enhanced electrical conductivity can dissipate charge accumulation at the blade 3 due to rubbing against the photoreceptor 2. The enhanced thermal conductivity can aid heat dissipation due to friction at the blade-photoreceptor interface.

Figure 2:
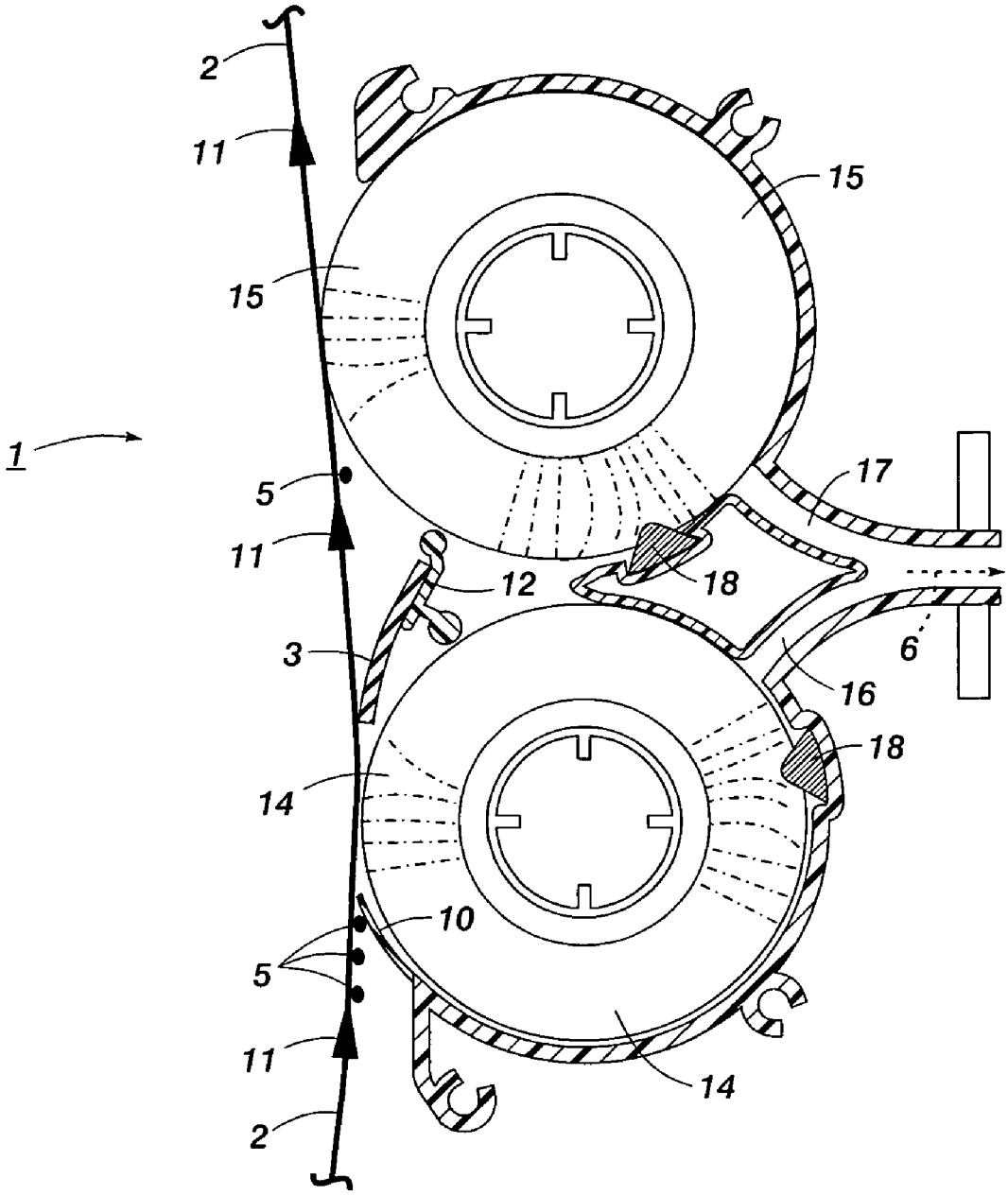
In FIG. 2, an embodiment of a marking system using two cleaning brushes and the cleaning blade of this invention is illustrated.

In FIG. 2, a second embodiment of the cleaning system described herein is illustrated. Two brushes 14 and 15 are used and a cleaning blade 3 is positioned adjacent to the first brush 14. The first brush 14 is charged in a manner that allows ample toner 5 to pass through to the blade tip 3, thus ensuring adequate lubrication at all times. A negative charge on the first brush 14 would remove any toner 5 that acquired a positive charge and allow all of the negatively charged toner 5 to pass through to the blade tip 3. Alternatively, a low positive charge on the first brush 14 would enable some level of cleaning of negatively charged toner 5 from the PC belt 2, if so desired, depending on the operating conditions at a given point in time. In either case, positive or negative charging of the first brush 14, the charge level would be such that ample toner is allowed to pass through to the blade tip 3. The first brush 14 is also used to transport toner 5 from the blade tip 3 to the vacuum channel 16. Another vacuum channel 17 is used to transport any residual loosened toner 5 from the second brush 15 to a vacuum collection means where it is disposed of. The second brush 15 can be charged positively or negatively to complement the polarity of the first brush 14. If the first brush 14 is negative to remove positively charged toner 5, the second brush 15 is positive to remove negatively charged toner 5 that was not removed by the blade tip 3. If the first brush 14 is positive to remove some negative toner 5, the second brush is negative to remove positively charged toner 5 that is not removed by the blade tip 3. If the Xerographic system is optimized in a manner to ensure only one polarity of toner arrives at the cleaning system 1, then both brushes 14 and 15 can be charged to the same polarity, that being opposite of the toner 5 polarity. The charge level on the first brush 14 would still be such that an ample amount of lubricating toner 5 would pass through to the blade tip 3. The flicker bars 18 positions are suitable for brushes that are rotating in a counterclockwise direction. The brush fibers hit the flicker bar 18 which compresses the fibers. Then as the fibers open up, they are exposed to the vacuum channels 16 and 17 for toner removal. Obviously, if the brushes 14 and 15 were rotating clockwise, the flicker bars 18 would be shown in a different location (preceding the vacuum channels 16 and 17). An entry shield 10 is positioned below the first brush 14 to capture loose toner 5 falling from the brush 14 or blade 3 of this invention. Unloaded polyurethane is typically used for cleaning blade materials. Obviously, other elastomeric materials may be used if suitable such as natural or synthetic rubbers. The small percentage of carbon nanotubes incorporated into the elastomer or polyurethane (either randomly or in a pattern) will improve the robustness of the elastomer without significantly compromising the desired elastomeric properties of blade 3.

Figure 3:
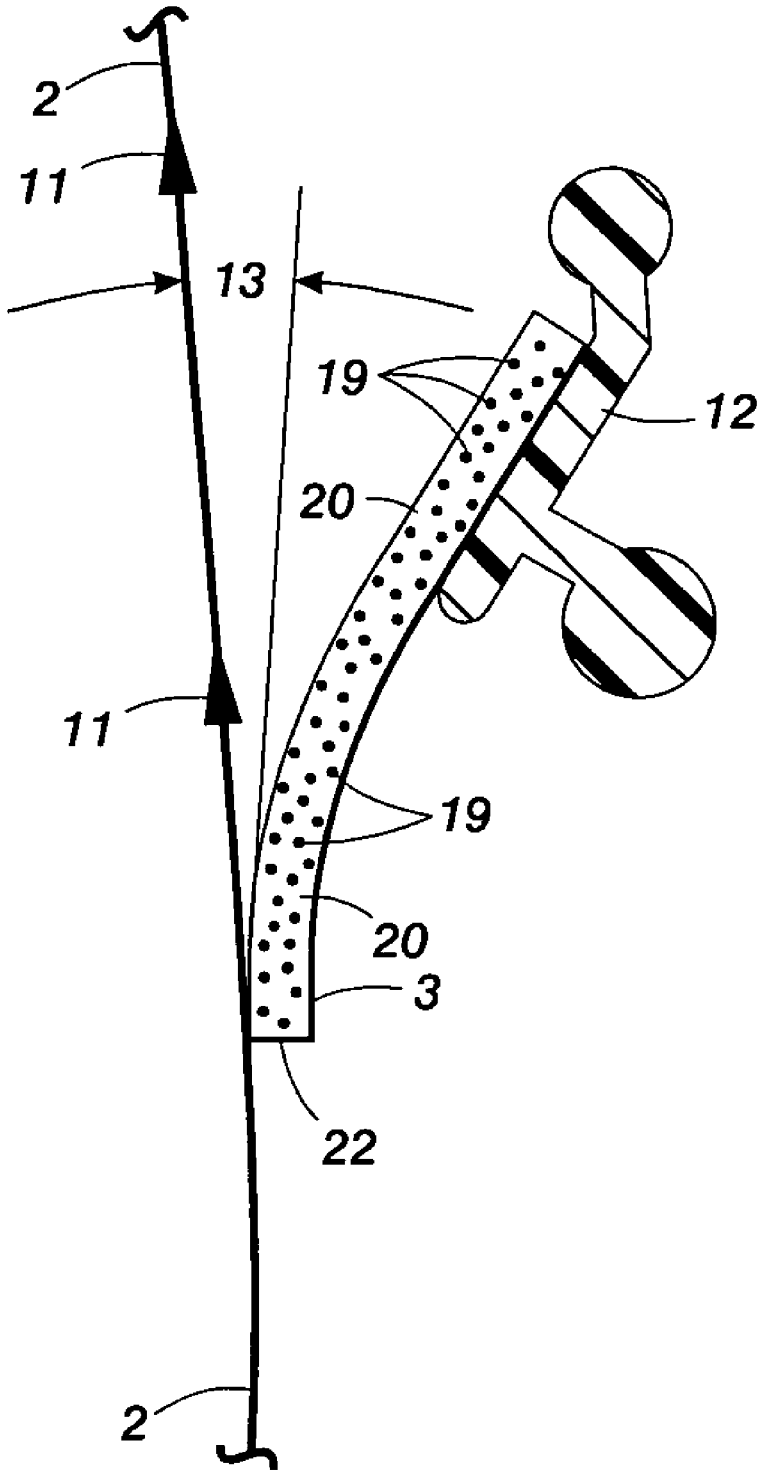
In FIG. 3, the elastomeric cleaning blade of this invention (in a non-brush system) as it contacts a photoreceptor or photoconductive belt is illustrated. The carbon nanotubes are embedded throughout the elastomer.
Figure 4:
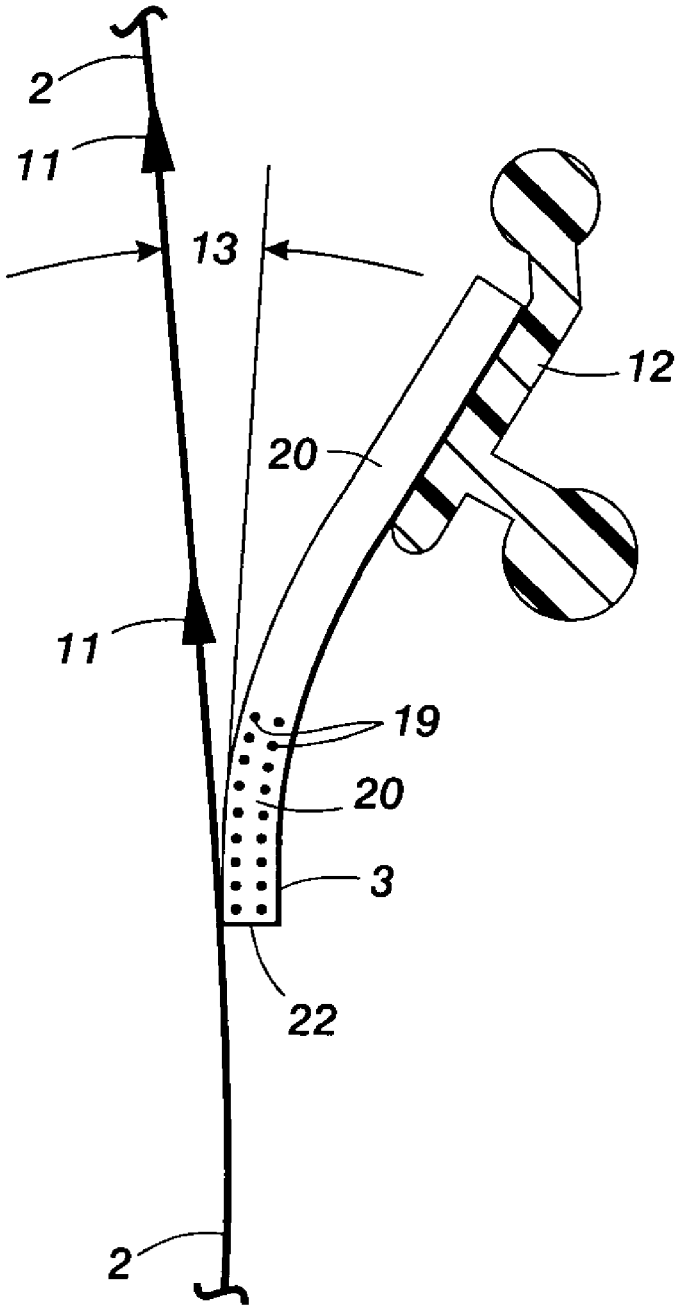
In FIG. 4, the carbon nanotubes are dispersed primarily on the front tip of the brush, as illustrated.
Figure 5:
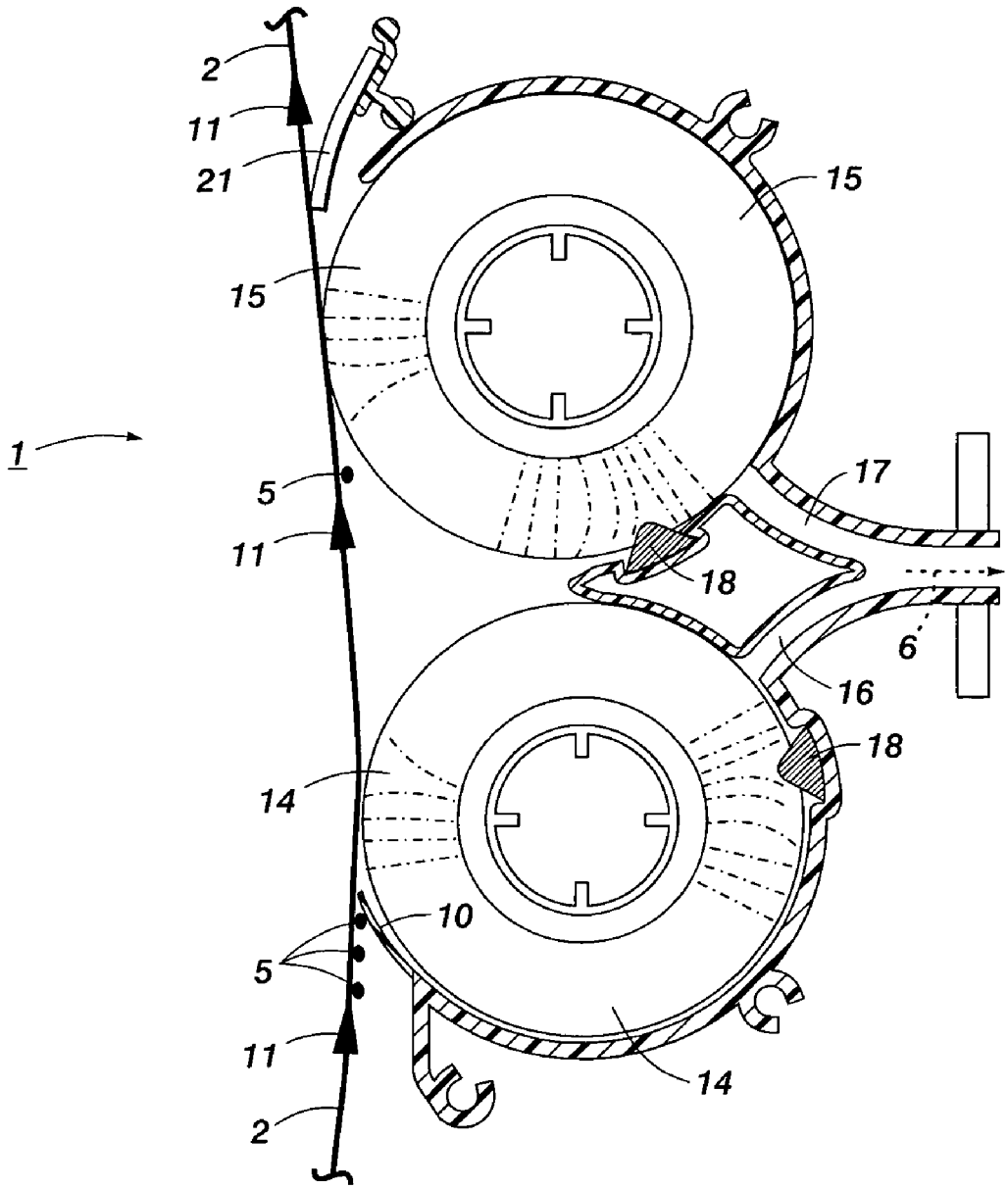
In FIG. 5, a spots blade is shown for use in a cleaning system of this invention.

In FIG. 3, the cleaning blade 3 of an embodiment is shown in an expanded view as it contacts PC belt 2. In FIG. 3 the carbon-nanotube random distribution with laminated blade is made by centrifugal casting. This blade 3 incorporates carbon nanotubes 19 throughout the elastomer 20 at about 1-60% by weight. A movable or floating support 12 for the cleaning blade 3 permits proper movement and support for blade 3 as it contacts PC belt 2. While any suitable angle of contact 13 between the PC belt 2 and the blade 3 may be used, an angle of from 5 to 30 degrees has been found to be effective, however, any suitable and effective angle may be used. This blade 3 of FIG. 3 and FIG. 4 can be used in the embodiments of FIGS. 1 and 2 and any other suitable embodiments. Any suitable amount of carbon nanotubes 19 may be used in blade 3 of FIGS. 3 and 4. An amount of 0.5-2.0% in one embodiment has been found to be very useful. This FIG. 3 also illustrates a cleaning station portion where only the cleaning blade 3 is used without cleaning brushes 14 and 15. The blade 3 of FIG. 4 is molded and used in the same embodiment or cleaning system as FIG. 3 except that in the molded blade 3 of FIG. 4 the nanotubes 19 are only dispersed at the front tip portion 22 of blade 3, whereas in FIG. 3 the nanotubes are randomly or pattern-wise dispersed throughout the entire blade or elastomer 20. In FIG. 3, the nanotubes 19 are dispersed randomly whereas in FIG. 4 the carbon nanotubes 19 are dispersed in a pattern or evenly spaced as it is molded. Obviously, the nanotubes 19 can be dispersed either way throughout the blade 3 (as in FIG. 3) or can be dispersed either way at the tip 22 of blade 3 (as in FIG. 4). In FIG. 5 a spots blade 21 is shown in a cleaning system. This spots blade 21 can be used, if suitable, alone or with the cleaning blade 3 as shown in FIG. 1. However, generally, the blade-brush cleanings shown in FIG. 1 and FIG. 2 do not require spots blades since the cleaning blade 3 will remove most film material. The spots blade 21 will have the same carbon-nanotube distribution and configuration as the cleaning brushes 3 of FIGS. 3 and 4.

In FIG. 6 an embodiment is shown where the carbon nanotubes 19 are dispersed primarily along the bottom edge 23 of blade 3. This blade would be manufactured by a centrifugal casting process (a common manufacturing process). A layer of nanotube 19 filled blade material would be cast on top of unfilled material layer 20 to form a laminate. When cured and cut to size, the nanotube filled layer of the laminate would be used as the cleaning edge of the blade. Therefore the nanotubes 19 can be randomly dispersed or distributed in elastomer 20, or can be evenly dispersed in elastomer 20. The nanotubes 19 may be located in the blade 3 throughout (FIG. 3) or in the bottom portion of the blade (FIG. 6) or in a front tip portion of the blade 3 (FIG. 4).

The configurations illustrated in the figures above are not limiting to the present disclosure. Any suitable marking system using a cleaning blade may use the nanotube containing enhanced durable cleaning blade of this invention.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A cleaning blade useful in a cleaning station of an electrophotographic marking system, said blade consisting of:

an elastomer and from 1-60% by weight of a carbon nanotube, wherein said elastomer is selected from the group consisting of a polyurethane, organic rubbers, ethylene diene and propylene diene, fortified organic rubbers, various copolymers, block copolymers, copolymer and elastomer blends, said blade comprising said carbon nanotubes having an increased electrical and thermal conductivity and enabled to enhance the dissipation of accumulated electrical charges at said blade and a photoconductive surface, and wherein said carbon nanotubes are selected from the group consisting of materials containing only carbon atoms, materials containing carbon atoms and boron, carbon atoms and nitrogen, carbon atoms and bismuth and metal chalcogenides and wherein said nanotubes are dispersed into said elastomer and are dispersed primarily at a blade location selected from the group consisting of a bottom edge portion only of said blade, throughout said entire blade, and only at a front tip portion of said blade.

2. The blade of claim 1 comprising 0.5-2% by weight of said nanotubes and wherein said nanotubes are dispersed throughout said blade.

3. The blade of claim 1 wherein said carbon nanotubes are in the form of carbon nanofibers.

4. The blade of claim 1 comprising up to 2% by weight of a carbon nanotube.

5. The blade of claim 1 wherein said blade consists essentially of said elastomer and at least an amount of carbon nanotubes that provide enhanced mechanical, electrical, and thermal conductivity to said blade, said carbon nanotubes dispersed in said elastomer in either a random or oriented manner.

* * * * *